US006539569B2

(12) United States Patent
O'Connell

(10) Patent No.: US 6,539,569 B2
(45) Date of Patent: Apr. 1, 2003

(54) MOTORIZED PATIENT TRANSFER SYSTEM FOR BEDS

(76) Inventor: Timothy B. O'Connell, 6501 Underwood Cove, Fort Wayne, IN (US) 46835

( * ) Notice: Subject to any disclaimer, the term of this patent is extended or adjusted under 35 U.S.C. 154(b) by 0 days.

(21) Appl. No.: 10/154,709

(22) Filed: May 24, 2002

(65) Prior Publication Data

US 2002/0133878 A1 Sep. 26, 2002

Related U.S. Application Data

(63) Continuation-in-part of application No. 09/517,730, filed on Mar. 2, 2000, now Pat. No. 6,425,154.

(51) Int. Cl.[7] ..... A47C 21/00; A61G 7/10

(52) U.S. Cl. ..... 5/662; 5/81.1 R; 5/83.1; 482/121; 482/904

(58) Field of Search ..... 5/662, 81.1 R, 5/83.1, 658; 482/904, 121

(56) References Cited

U.S. PATENT DOCUMENTS

| | | | |
|---|---|---|---|
| 798,114 | A | 8/1905 | Rosenthal |
| 1,341,483 | A | 5/1920 | Slocum |
| 3,176,322 | A | 4/1965 | Mulcahy |
| 3,739,793 | A | 6/1973 | Wilson |
| 4,253,207 | A | 3/1981 | Marcyan |
| 4,679,265 | A | 7/1987 | Wicks |
| 4,686,727 | A | 8/1987 | Wilkinson |
| 4,932,090 | A | 6/1990 | Johansson |
| 5,195,200 | A | 3/1993 | Leoutsakos |
| 5,231,721 | A | 8/1993 | Fish |
| 5,257,426 | A | 11/1993 | Leoutsakos |
| 5,335,385 | A | 8/1994 | Brown |
| 5,400,450 | A | 3/1995 | Leoutsakos |
| 5,471,689 | A | 12/1995 | Shaw et al. |
| 5,787,530 | A | 8/1998 | Brix |
| 6,163,906 | A | 12/2000 | Kay |

FOREIGN PATENT DOCUMENTS

| | | |
|---|---|---|
| CH | 58088 | 9/1911 |

OTHER PUBLICATIONS

Sears Home Health Care Catalog 1999–2000, p. 55.

*Primary Examiner*—Alexander Grosz
(74) *Attorney, Agent, or Firm*—O'Malley and Firestone

(57) ABSTRACT

A patient self-assist transfer aid provides an open box frame having a base for fitting beneath a mattress of a bed, a riser section extending upwardly from the base for extending around an edge of the mattress and a positioning section for extending out over the mattress from the riser section. The open box frame may be positioned around the mattress end at the foot of the bed to leave the major sides of the bed open for ease of access. A linkage is fitted to the positioning section of the open box frame and may be extended therefrom to position a handle within easy grasp of a person laying in the bed. A spring system urges the linkage outwardly, but is balanced by a motor and pulley system. A handle is pivotally attached to the linkage and for grasping by a patient recumbent in the bed for raising himself with motor assistance or for lowering himself into bed.

11 Claims, 5 Drawing Sheets

MOTORIZED PATIENT TRANSFER SYSTEM FOR BEDS

CROSS REFERENCE TO RELATED APPLICATION

This application is related to and a continuation in part of application Ser. No. 09/517,730 filed Mar. 2, 2000, now U.S. Pat. No. 6,425,154.

BACKGROUND OF THE INVENTION

1. Field of the Invention

The present invention relates to apparata for use around a bed for aiding a person in moving himself from a fully reclined position on the bed to a standing position adjacent the bed and back.

2. Description of the Art and Problem

Numerous systems for helping patients get into and out of bed without caregiver assistance exist. Many of the references teach bed rail and handle systems, adapted by positioning and shaping, to give support to a person moving from a sitting position on a bed to a standing position adjacent the bed, or from a standing position back to a sitting position. Indeed, for many infirm individuals, moving from a sitting to a standing position is the greatest challenge and such devices are very useful for maintaining balance as they stand. However, the problems involved in getting into and out of bed frequently involve more than moving from standing to sitting or from sitting to standing. Some references implicitly recognize that helping the patient stand up from, or sit down on, a bed or chair is just one part of the problem, for example U.S. Pat. No. 3,739,793 to Wilson.

Some conditions, such as Parkinson's disease, can contribute to a progressive degeneration of the abdominal muscles, which makes sitting up without assistance difficult or impossible. Temporary conditions, such as recovery from abdominal surgery, can also leave the abdomen weak. Relatively few references deal with bed ingress and egress assistance devices which provide assistance to individuals in sitting up in bed. One reference that does teach such a device is U.S. Pat. No. 4,679,265 to Wicks. Wicks teaches a tether hooked to an anchoring member, which is provided by a U-shaped hook sized to be fitted around the foot of a bed mattress. Using the tether a person can help themselves sit up from a recumbent position by pulling themselves up on the tether. While the device is exceedingly simple and unobtrusive, it is unclear how the tether remains positioned for easy grasping by the bed occupant over the course of a night. Nor does the system do anything for individuals who have lost substantial upper body strength. A trapeze system is taught in U.S. Pat. No. 4,686,727 to Wilkinson, which provides assistance to patients in sitting up from bed. Another such system is that taught in U.S. Pat. No. 4,253,207 to Marcyan. In trapeze systems a bar or handle is suspended over the bed for grasping by the bed occupant.

A common theme among several references is ease of installation and portability, which is carried out in part by tubular construction of rail systems and extensions of the tubing to fit under and to be anchored by the bed's mattress. U.S. Pat. No. 5,471,689 to Shaw is an example of a device incorporating such features.

The present applicant taught a patient self-assist transfer aid for use with a bed in a prior application, now U.S. Pat. No. 6,425,154. The self-assist transfer aid comprises an open box frame having a base for fitting beneath a mattress of a bed, a riser section extending upwardly from the base around an outside edge of the mattress and a positioning section for extending out over the mattress from the riser section. The open box frame may be positioned around the mattress end at the foot of the bed to leave the major sides of the bed open for ease of access. A linkage is fitted to the positioning section of the open box frame and may be extended therefrom to position a handle within easy grasp of a person lying in the bed or laying down on the bed. A spring system biases the linkage to a retracted position in the open box frame. A handle is pivotally attached to the linkage and for grasping by a patient lying in the bed or lowering him or herself into bed.

SUMMARY OF THE INVENTION

An object of the invention is to provide an apparatus aiding the infirm in getting into and out of bed by helping the person move from a standing position adjacent the bed to a recumbent position on the bed and back.

Another object of the invention is to provide a patient mobility aid for use with beds which does not limit access to the bed.

It is a still further object of the invention to provide an aid for use with beds which is readily removed or placed in the bed.

It is yet another object of the invention to provide patient control for a motorized lift system.

According to the invention there is provided a motorized patient transfer system for use with a bed. The transfer system comprises an open frame having a flattened base positionable beneath a mattress of a bed, a riser section extending upwardly from the base around an outside edge of the mattress and a positioning section extending out over the mattress from the riser section. The open frame may be positioned at the foot of the bed around an end, preferably the foot, of the bed to leave the major sides of the bed open for ease of access. A linkage is fitted to the positioning section of the open frame and supports a handle which may be extended therefrom to within easy reach of a person lying in the bed or laying down on the bed. The handle is pivotally attached to the linkage for grasping by a patient lying in the bed or lowering him or herself into bed. A spring system biases the linkage toward an extended position outward from the open frame toward the head of the bed. A retraction motor is mounted on the frame and coupled to the linkage by a flexible cable and constant rotation direction payout pulley for retracting the linkage and handle. The retraction motor is controlled from a switch mounted within the reach of the patient.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1A:
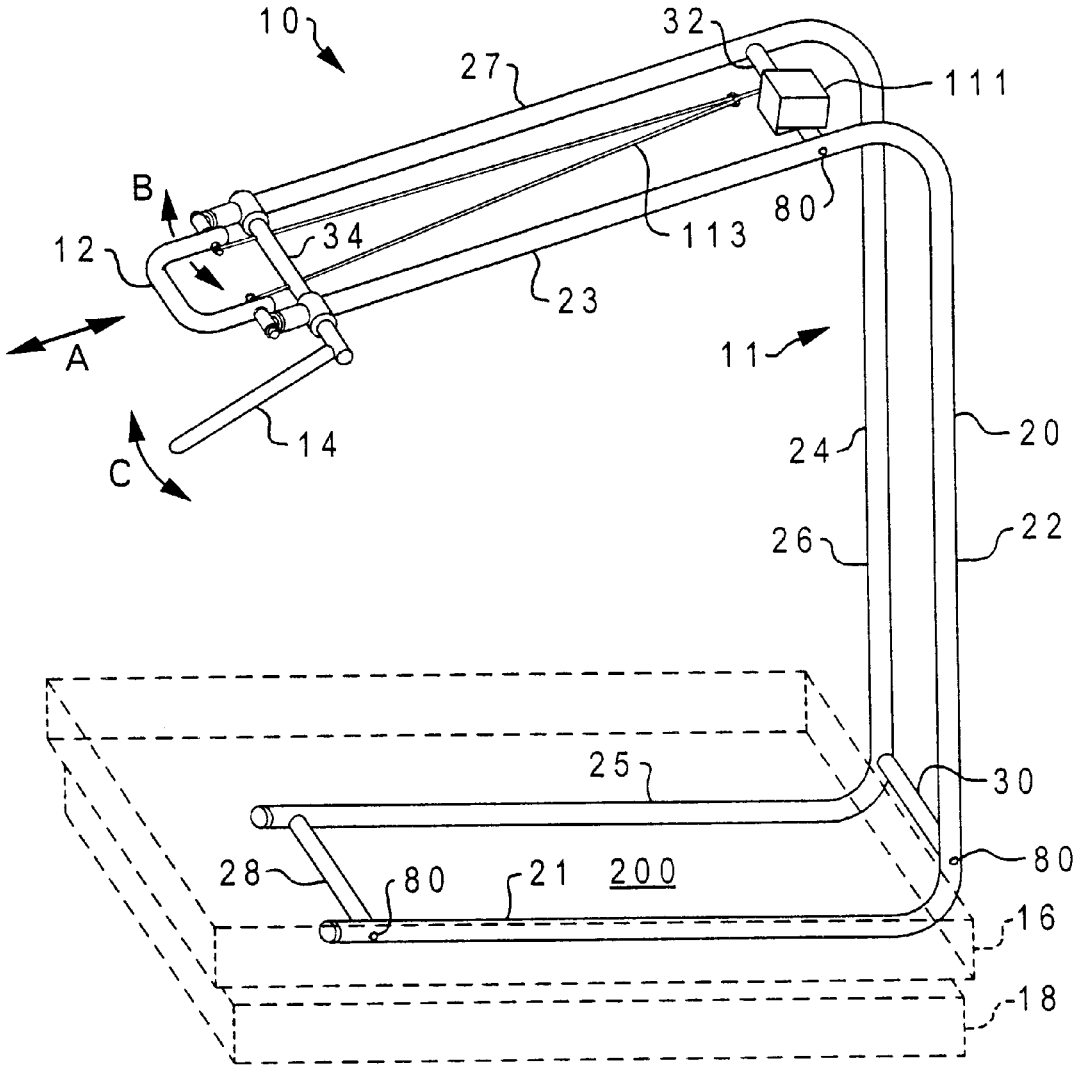
FIGS. 1A–B are perspective views of a preferred embodiment of the self-assist mobility aid of the invention.
Figure 1B:
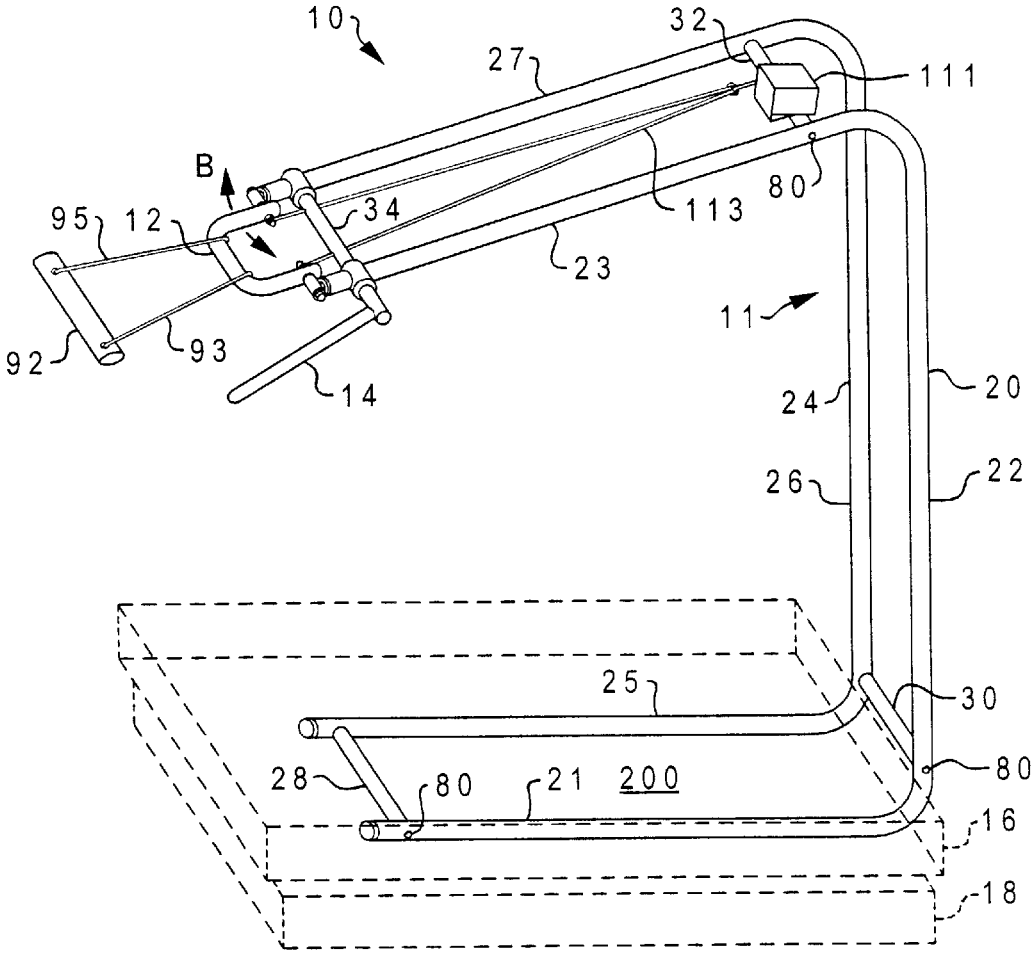
Figure 2:
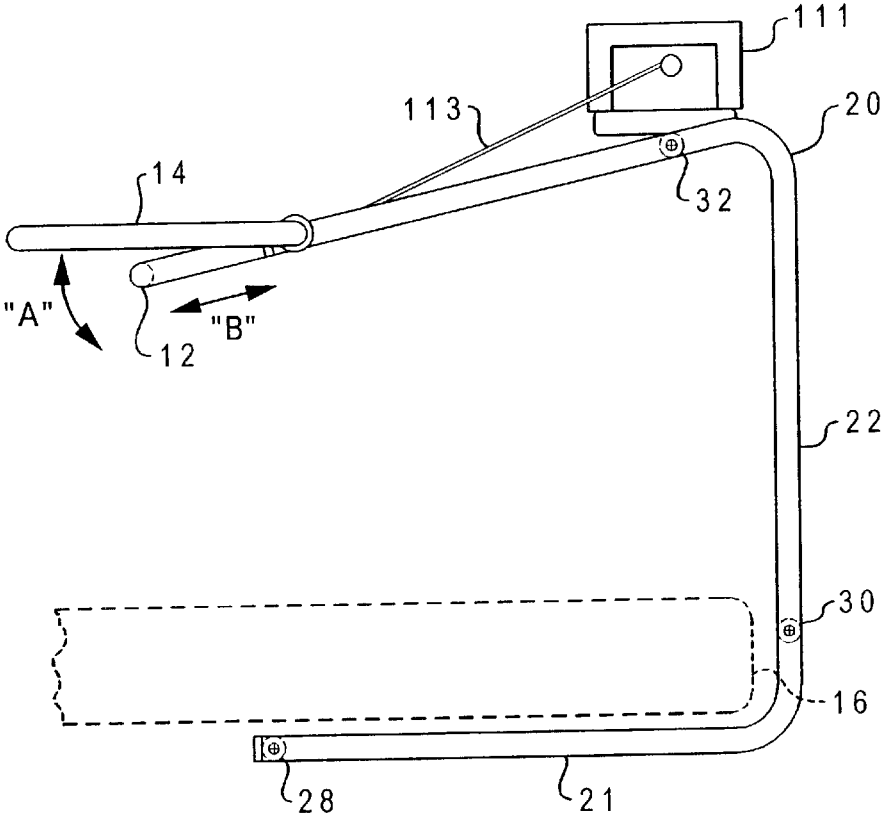
FIG. 2 is a side elevation view of the embodiment of FIGS. 1A/B.

Referring now to FIGS. 1A, 1B and 2, a preferred embodiment of transfer system 10 of the present invention is illustrated. Transfer system 10 comprises a box frame 11 which is shaped to provide a base 200 which fits between a mattress 16 and a foundation 18 such as box springs or a bed platform. So positioned, frame 11 rests on its base, extending from one edge of the base around an edge of the mattress 16, preferably the end of the mattress located at the foot of a bed. From the exposed edge of the base frame 11 rises vertically for a distance and then bends back over mattress 16. The end of frame 11 opposite the base is thus suspended over mattress 16. On the end of frame 11 over mattress 16, a handle 12 and a support brace 14 are positionable for the use of a person getting into and out of bed. Normally, a person lying on mattress 16 can grab handle 12 when extended and be pulled to a sitting position by the handle as it is retracted. For individuals with limited use of their arms, a harness 92 may be attached to handle 12 by straps 93 and 95. The individual can than fit harness 92 around their back with the straps 93 and 95 extending from under their arms to be pulled to a sitting position. Alternatively, handle 12 can be removed and harness 92 fitted directly to the linkages used for attachment of the handle to frame 11.

The upper section of frame 11, corresponding in part to arms 23 and 27, slants downwardly from a location over the end of the mattress 16 toward the head of the bed. Handle 12 is movable on frame 11 from the end of the frame over the bed in the directions indicated by double arrow "A". Handle 12 thus may be extended somewhat downwardly toward the head of the bed (illustrated in FIG. 4) and retracted back into frame 11. Handle 12 is disposed on rods which extend from within frame tubes 20 and 24 and which are spring biased to urge the handle outwardly from frame 11 out over mattress 16 toward the head of the bed. A handle retraction motor 111 is mounted to frame 11 on cross member 32 and is connected to handle 12 by a flexible tether 113 set on a pulley (illustrated below). Tether 113 provides for retracting handle 12 into frame 11 with sufficient force to overcome the bias of the spring. When the weight of a person's torso hangs from handle 12 the person is gently lowered onto the bed from a sitting position and can, from a recumbent position, pull the handle towards themselves. Handle 12 is also rotatable in the directions indicated by double arrow "B" on an axis which is parallel to the upper major surface of mattress 16 to allow the handle to be pushed out of the way or pulled to a more convenient position.

A support brace 14 is also mounted to a cross member 34 near the upper end of frame 11. Support brace 14 may be rotated in the directions indicated by double arrow "C" about an axis substantially perpendicular to the upper major surface of mattress 16. Brace 14 may be moved out over one of the major edges of mattress 16 to provide support to a person moving from a standing position along side the bed to a sitting position on mattress 16, or from a sitting position on the mattress to standing alongside the bed.

Frame 11 is constructed from two tubular members 20 and 24, and a plurality of transverse cross members 28, 30, 32 and 34. Each tubular member has, in turn, three major sections corresponding to the principal parts of the frame 11. For tubular member 20 there is a base leg 21, an upright 22 and a positioning arm 23. Tubular member 20 is preferably formed from a single tube with curved transition sections between the major sections. Similarly, tubular member 24 has a base leg 25, an upright 26 and a positioning arm 27.

Frame 11 has three major sections, defined by their respective functions, which are: as a base or foundation for the frame; as a riser disposed between the base and an upper support platform to allow positioning of the frame around an edge of the bed; and as a platform positioned above the bed for the active elements of the support system 10. Frame 11 stands on one side of the frame, comprising base legs 21 and 25 and cross member 28, which form the base. The base is illustrated as positioned below a mattress 16, which stabilizes frame 11 on a box spring or platform 18. The riser corresponds to vertical uprights 22 and 26 and cross member 30. The platform to position patient aid braces and handles within easy reach of a patient is formed by arms 23 and 27 along with cross members 32 and 34.

Vertical support for arms 23 and 27 is provided by vertical uprights 22 and 26, respectively. Uprights 22 and 26 are braced against on one another be cross member 30. Positioning arms 23 and 27 depend from uprights 22 and 26, respectively, and are linked to one another by cross members 32 and 34. Cross members 28,30, 32 and 34 are attached to tubular members 20 and 24 by suitable fastening means. For cross members 28, 30 and 32 these may include penetration of the tubular members 20 and 24 by the ends of the cross members coupled with screws through the bodies of the tubular members into the cross members. Cross member 34 serves other functions and is attached to tubular members 20 and 24 somewhat differently as is described below. Frame 11 generally defines a U-shaped frame, which can be fitted around one edge of bed mattress and which is held in place by the mattress.

Specific construction elements, such as tubular frames, joints, bends and cross members, including consideration of their size and material may vary upon specific application of the device, for example in houses or health care facilities, or the type of bed used. Spring types, fasteners and the like may be chosen based on cost considerations or the desire for the highest refinement of the tool. The basic design concept would be unchanged. For example, hospital and nursing home beds are different than beds normally found in individual houses or apartments in that a spring grid is all that is provided immediately under the top level bedding element. No box spring is provided and as a result no integral surface exists as a base. In such an application a tubular frame base would not be appropriate. In some applications welded joints joining distinct tubes may be used in place of a single bent tubes, or rectangular tubing may be used instead of circular cross-section tubing to enhance rigidity. The retraction motor is preferably of a type generating high torque at low rotational speeds, such as provided by vehicle windshield wiper motor.

FIG. 2 is a side elevation of frame 11 illustrating more fully tubular member 20 and the position relative thereto of handle 12. Brace 14 swings on a pivot axis 70 which is perpendicular to the upper major surface of mattress 16. A plurality of screws 80 are set in tubular member 20 hold cross members 28, 30 and 32 in place. Similar screws (not shown) join the cross members 28, 30 and 32 to tubular member 24.

Figure 4:
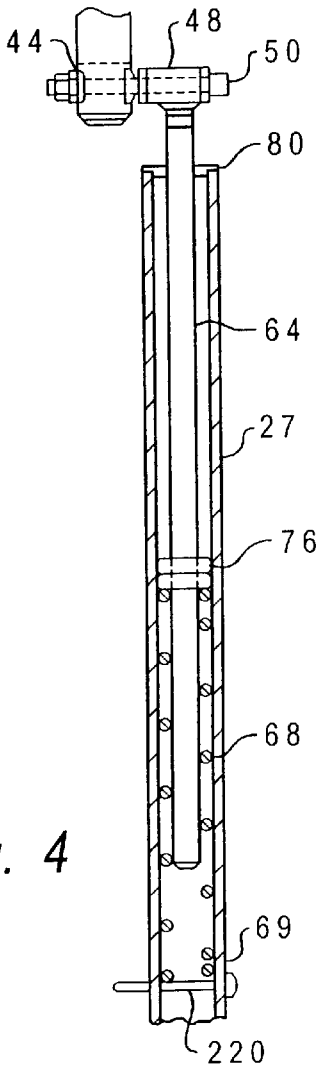
FIG. 4 is a cross sectional view of an extensible piston rod used in the first embodiment.
Figure 3A:
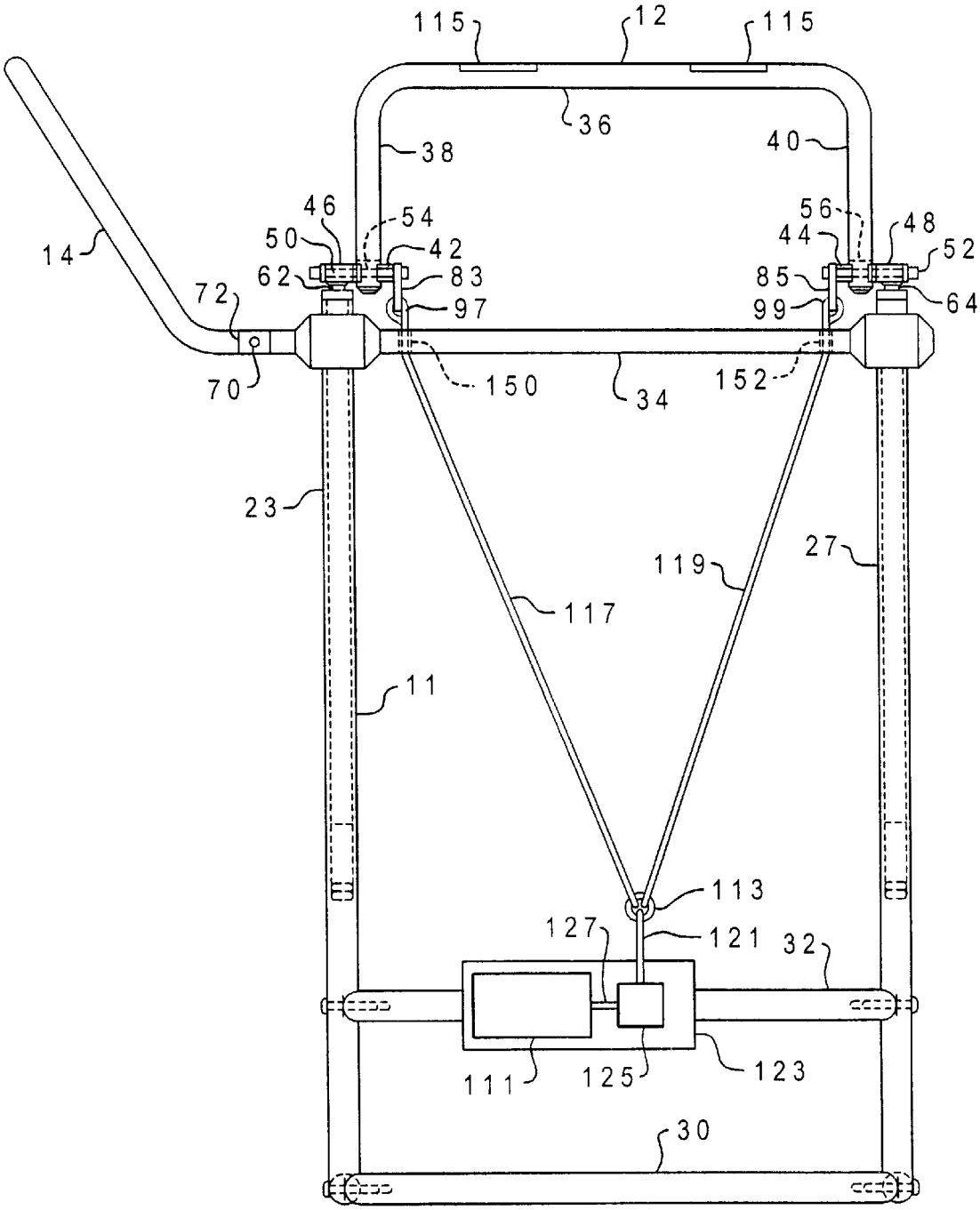
FIGS. 3A–B are top plan views of the invention.
Figure 3B:
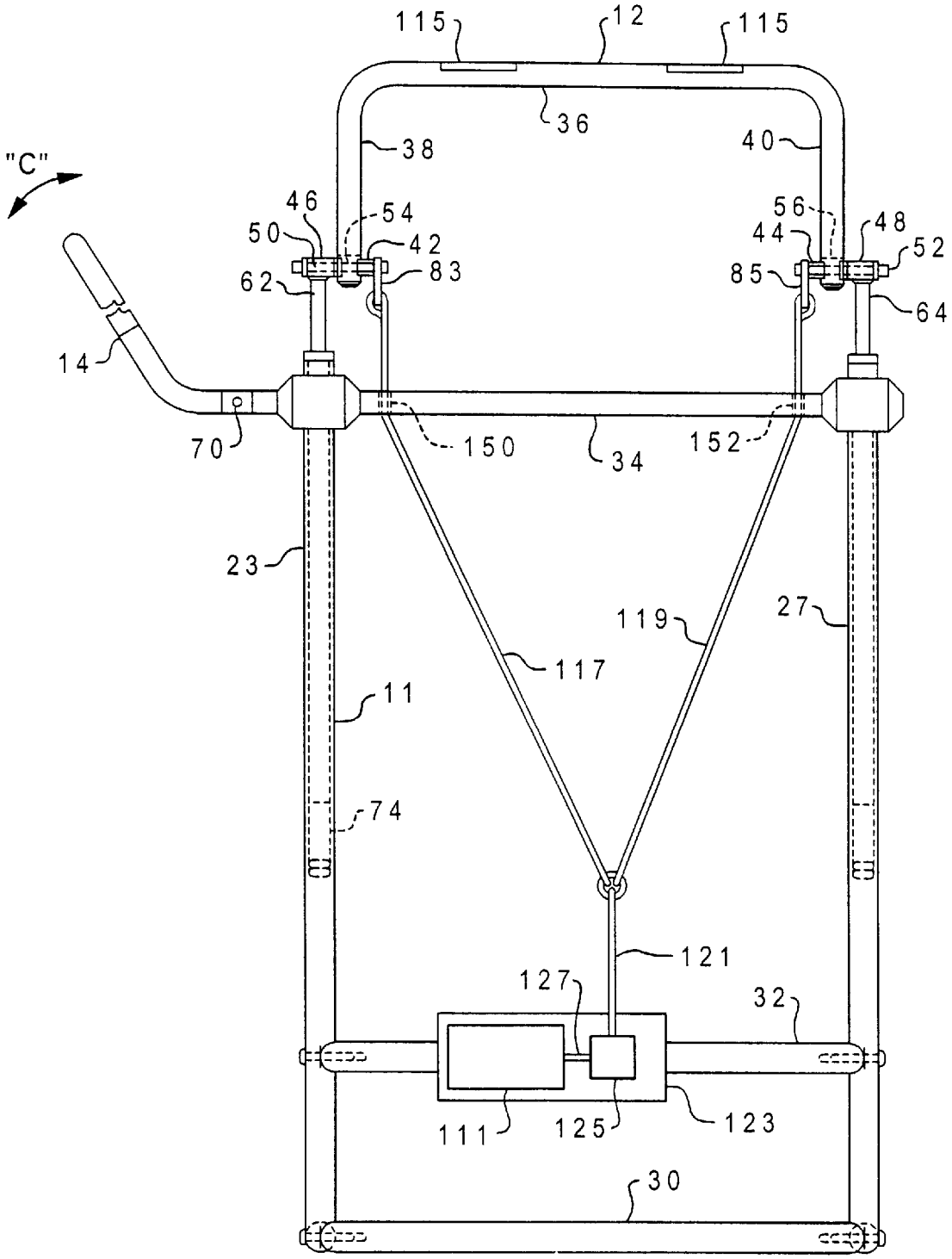

Referring now to FIGS. 3A–B and 4, the mechanical details relating to positioning of handle 12 are illustrated.

Handle 12 is mounted on co-axial pivoting mounts 42 and 44, which are provided by rods 50 and 52 to position a gripping section 36 within easy reach of a person laying in a bed. Rods 50 and 52 are mounted in cylinders 46 and 48 with rod exerts 54 and 56 extending from the cylinders to mate with holes through handle arms 38 and 40, respectively. Appropriate threaded nuts or other fastening elements may be used to hold handle 12 on rod exerts 54 and 56.

Retraction of handle 12 is powered by a motor 111, which is mounted on a platform 123 which in turn is set on cross rod 32. Motor 111 is turned on by depression of either of switch pads 115 which may be placed on handle 12 to be easily reached by a user. The position indicated for switch pads 115 is illustrative only and many other locations may be used for the control switch such as a free box which may be placed on an adjacent table. Typically the switches will be spring loaded and will cut off if continuous pressure is not applied. Motor 111 turns a shaft 127 which in turn drives a constant rotation direction pulley 125. Tether system 113 is connected to retract a cable between pivot mounts 42 and 44 and the constant rotation direction payout pulley 125 to effect retraction of handle 12. Tether system 113 comprises a base cable 121 which winds on pulley 125. Cable 121 divides into two parts, 117 and 119 which are looped through holes 97 and 99 in extensions 83 and 85, which depend from mounts 42 and 44, respectively. Tether segments 117 and 119 feed though openings 150 and 152 through cross member 34.

Extension and retraction of handle 12 relative to frame 11 is supported on piston rods 62 and 64, which extend from the bases of mounting cylinders 46 and 48, respectively, and which are partially inserted into the open ends of positioning arms 23 and 27. Rods 62 and 64 are free to move in and out of positioning arms 23 and 27 except as limited rod ends 67 and 69 and by restraining caps 78 and 80. Restraining caps 78 and 80 close the open ends of positioning arms 23 and 27 save for annular openings sized to pass rods 62 and 64. Restraining caps 78 and 80 are of smaller diameter than the width of rod ends 67 and 69. This allows the free traversal of the rods 62 and 64.

Referring to FIG. 4, a cross sectional view of arm 27 illustrates a spring biasing mechanism applicable to both arms. Compression spring 68 biases rod 64 outwardly from the tube forming positioning arm 27 toward an extended position. Compression spring is located between a piston rod shoulder stop 76 located around piston rod 64 and a screw 220 which positions one end of cross member 32. If desired, the force generated by spring 68 may be adjusted by building up shoulder 76, or by selecting a spring with a different spring constant.

For a patient with minimal upper body strength and no abdominal strength, handle 12 should be easily drawable, if speed limited, the retractive force applied by the tether 113 balancing the outward force supplied by spring 68 and a comparable spring in arm 23. Retractive force, overcoming the spring forces and supporting the weight of the patient is supplied by motor 111. The maximum speed of extension may be set by limiting the speed at which constant rotation direction payout pulley 125 can turn.

Brace 14 is pivotally mounted to an extension of cross member 34, which positions the pivot 70 for the brace at a point horizontally displaced from the upper or positioning section of frame 11 toward an edge of the bed. A pivot stop 72 limits travel of brace 14 toward the center of the bed and allows the infirm user of the apparatus to pull him or herself around to bring their legs over the edge of the bed. Brace 14 may then be pivoted outwardly over the edge of the bed, or to other convenient positions, to provide a support for the individual as he or she stands. It should be apparent that brace 14 and handle 12 may be used to reverse the process as well.

Figure 5:
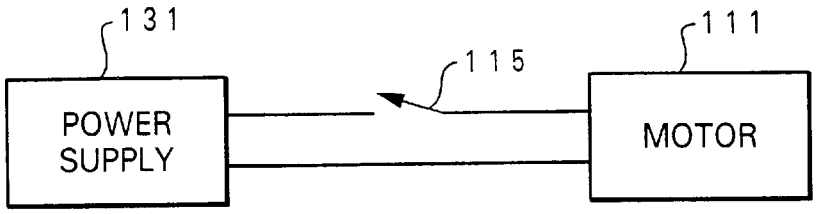
FIG. 5 is a circuit diagram of the motor actuation circuit.

FIG. 5 illustrates a simple series circuit suitable for providing energization of motor 111. A power supply 131 may be connected to motor 111 by simple closure of switch 115. As stated above, switch 115 is biased open. Wires for switch 115 are typically snaked through the tubing of the handle and of frame 11 to reach motor 111. Where handle 12 is removed for a harness an independent switch box may be provided.

The present invention aids the infirm in getting into and out of bed, generally without assistance of another individual, or in the case where two elderly persons live together, eases the task of helping another person out of bed. The preferred embodiment is readily installed on most beds, requiring no permanent physical modification of the bed, and is readily removed if desired. When positioned with a bed the apparatus does not limit access to the bed by blocking the major sides with rails.

While the invention is shown in only one of its forms, it is not thus limited but is susceptible to various changes and modifications without departing from the spirit and scope of the invention.

What is claimed is:

1. Apparatus for assisting a person in moving back and forth between a reclined position on a bed and a standing position adjacent the bed, the apparatus comprising:

an open frame;

a base section to the open frame for supporting the open frame from under a bed mattress;

a riser section to the frame extending upwardly from the base section around an end edge of the bed mattress leaving side edges of the mattress unobstructed;

a projection section extending from the riser section out over the bed mattress;

an extensible linkage mounted in the projection section;

a spring for biasing the extensible linkage toward an extended position from the riser section;

means for supporting a person from the extensible linkage; and a retraction motor mounted with respect to the open frame and linked to the extensible linkage to assist pulling a recumbent person using the means for supporting.

2. Apparatus as set forth in claim 1, wherein the means for supporting is a handle, pivotally mounted to the extensible linkage and positionable to place the handle within easy reach of a person recumbent on the bed mattress.

3. Apparatus as claimed in claim 2, and further comprising:

a support handle depending from the frame giving a person lateral support for standing up from the bed or sitting down on the bed.

4. Apparatus as set forth in claim 1, wherein the means for supporting comprises a harness attached with respect to the extensible linkage.

5. Apparatus as set forth in claim 1, the extensible linkage further comprising:

first and second piston rods for insertion into the projection section of the frame; and retainers for locking the piston rods onto the frame.

6. Apparatus as claimed in claim 5, wherein the spring further comprises:

first and second compression springs positioned to urge the first and second piston rods outwardly from the projection section.

7. Apparatus as claimed in claim 6, further comprising a constant rotation direction payout pulley attached to the retraction motor and a tether connected between the constant rotation direction layout pulley and the handle.

8. A transfer aid for use with a bed, comprising:

an open box frame having a base positionable beneath a bed mattress, a riser section extending upwardly from the base around an edge of the bed mattress and a positioning section extending out over the mattress from the riser section, the open box frame being positionable with respect to the bed for leaving access to the bed open along the major elongated edges of the bed;

a linkage fitted to the positioning section of the open box frame and extendable therefrom;

a spring bias element operating between the linkage and the positioning section for urging extension of the linkage; and a retraction motor mounted with respect to the frame and attached to the linkage to retract the linkage.

a handle attached to the linkage and positioned by the positioning section to be reachable by a patient recumbent in the bed.

9. A patient self-assist transfer aid as claimed in claim 8, wherein the retraction motor drives a constant rotation direction payout pulley and the constant rotation direction payout pulley is attached to the linkage by a flexible tether.

10. A patient self-assist transfer aid as claimed in claim 9, where the spring bias element force is insufficient for force extension of the linkage against the constant rotation direction payout pulley.

11. An apparatus for supporting and aiding lifting of a person during movement between recumbent and sitting positions and during movement between sitting and standing positions relative to a bed, the apparatus comprising:

first and second horizontally spaced, generally U-shaped tubular members;

interconnecting elements connected between the U-shaped tubular members bracing the members on one another;

each of the U-shaped tubular members having lower portions laying in substantially the same plane for fitting between a mattress of a bed and a supporting foundation for the mattress;

each of the U-shaped tubular members having substantially coplanar upper sections with open ends;

first and second piston rods, each of which is partially inserted into the open end of an upper section and extensible therefrom;

a handle coupled to the uninserted ends of the piston rods;

first and second springs acting on the first and second piston rods for extension of the first and second piston rods from the upper sections;

a motor mounted with respect to the frame;

a constant rotation direction payout pulley driven by the motor; and a tether connected between the constant rotation direction payout pulley and the handle for retracting the handle.

* * * * *